US005077913A

United States Patent [19]

Akerblom et al.

[11] Patent Number: 5,077,913

[45] Date of Patent: Jan. 7, 1992

[54] SELF-CLEANING STEAMBOX

[75] Inventors: Mikael Akerblom; Anders Hallgren, both of Borlange, Sweden

[73] Assignee: Measurex Corporation, Cupertino, Calif.

[21] Appl. No.: 401,632

[22] Filed: Aug. 31, 1989

[51] Int. Cl.[5] ..... F26B 19/00

[52] U.S. Cl. ..... 34/85; 34/155

[58] Field of Search ..... 34/155, 156, 85, 23, 34/16, 18, 114; 15/300 R, 301, 316 R, 317, 318; 118/302; 165/95

[56] References Cited

U.S. PATENT DOCUMENTS

| | | | |
|---|---|---|---|
| 1,160,724 | 11/1915 | Landin | 34/155 |
| 3,404,463 | 10/1968 | Kemp | 34/23 |
| 3,750,306 | 8/1973 | Rodwin et al. | 34/155 X |
| 4,358,900 | 11/1982 | Dove | 34/155 X |

*Primary Examiner*—Henry A. Bennet

*Attorney, Agent, or Firm*—Spensley Horn Jubas & Lubitz

[57] ABSTRACT

A self-cleaning steambox including means for directing jets of cleaning fluid across the steambox faceplate to remove obstructing material from the steam holes.

11 Claims, 3 Drawing Sheets

SELF-CLEANING STEAMBOX

BACKGROUND OF THE INVENTION

1. Field of the Invention

The present invention relates to a type of steam distributor known as a "steambox" which is used in the manufacture of sheet materials, and in particular, to a steambox design which increases the production rate and quality of manufactured paper sheet.

2. Description of Related Art

One of the parameters used in grading sheet materials is the moisture content of the material For example, in the paper production process, various grades of paper having different moisture contents are produced to suit various applications.

Paper production typically begins with a wet mass of wood pulp fibers, called a "slurry". The slurry is laid out in a flat sheet. Water is then removed from the slurry, in stages, using several different techniques until a dry usable sheet of paper is obtained. FIG. 1 illustrates an example of such a papermaking process. In particular, FIG. 1 illustrates, in highly simplified cross-sectional form, a Fourdrinier-type papermaking machine 10. The papermaking machine 10 includes a headbox 12 which discharges the slurry 14 to a porous conveyer belt 16 called a "wire". In the first stage of drying, water is drained from the pulp through the wire 16. The paper sheet 18 then travels between a porous vacuum roll 20 and the faceplate 22 of a steambox 24. This steambox 24 jets steam against the sheet 18. As shown by arrows 25, the steam is drawn from the steambox 24, through the sheet 18 and into the vacuum roll 20. Water from the slurry is also drawn into the vacuum roll 20.

The steam treatment may cause an increase in sheet temperature of approximately 30° C. The increased temperature decreases the viscosity of the water in the sheet 18 so that the water can be efficiently squeezed and/or suctioned out of the paper sheet 18 in a subsequent section of the papermaking machinery known as the "press section" 28. The design of the press section 28 can vary greatly between different papermaking machines Typically, however the press section 28 will include a number of rolls 30 which squeeze water out of the sheet 18 and endless felt belts 32 which absorb water from the sheet 18. Because the steam heats the water, and heated water has decreased viscosity, the pressing and sectioning of water out of the sheet is rendered more effective In still later drying steps, the sheet 18 is typically passed over several heated drums 34 in the so-called "dryer section" 36 of the papermaking machine 10. These drying drums 34 are typically hollow and made of steel. The drums 34 are heated by steam flowing through the drums 34.

In the production of many paper products, it is desirable to automatically control the "cross-directional" (i.e., the direction across the width of the sheet perpendicular to the direction of sheet movement) moisture content of the paper sheet using a steambox. Many papermaking machines have scanning moisture sensors which continuously scan back and forth across the width of the sheet and sense the sheet moisture content at various locations across the sheet as the paper is being manufactured. Such a moisture sensor 38 is schematically illustrated in FIG. 1. The moisture sensor 38 may be mounted to a carriage (not shown) which travels back and forth across the width of the sheet 18. The moisture content of the sheet is thus measured at intervals or "slices" across its width. The information from this continuous moisture measurement can be fed to a computerized controller 40, such as the main process control computer for the papermill. The controller then separately and individually controls the amount of steam applied by the steambox to various slices of the sheet based upon the sensed moisture content.

Examples of automatically controllable steam distributors are shown in U.S. Pat. Nos. 4,253,247 and 4,580,355, which are incorporated herein by reference These patents teach multi-chambered steam distributors in which steam flows from a steam pipe through a valve associated with each chamber, into each chamber, and then is directed to the sheet slice adjacent each chamber. The steam flow out of each chamber and toward an adjacent slice of the sheet is controlled by progressively opening or closing the associated valve.

A typical steambox is divided into sections, such that each section spans only a few inches across the width of the sheet. Each section of the steambox is separately controllable to jet varying amounts of steam against the opposing portion of the sheet Based upon the measured moisture profile of the sheet across its width, the controller adjusts the amount of steam jetted from the steambox at each cross-directional section or slice to achieve the desired moisture profile along the cross-direction of the sheet. As more steam is jetted from a particular chamber of the steambox onto an opposing slice of the sheet, that slice becomes hotter and the water viscosity in that slice therefore decreases; thus, the more effectively water may be removed from the hot sheet. In other words, the use of more steam results in a drier sheet section Conversely, as less steam is applied to a slice, the drying action of the vacuum roll 20 and press section 28 becomes less efficient, and thus that slice retains more moisture.

According to the design of certain steamboxes, the faceplate of the steambox is perforated with numerous small steam holes to provide an even distribution of the steam across the width of any one slice. For example, a typical faceplate may include four ⅛ inch diameter holes per square inch. Unfortunately, however, since papermaking is a high speed process, dust, composed mostly of paper fibers and other material used to make paper, such as mineral fillers, tends to fly off the surface of the sheet during production. This dust tends to accumulate on all available surfaces of the papermaking machinery, including the faceplate of the steambox. The accumulation of such dust is especially prevalent in the manufacture of relatively light paper grades having a porous texture, such as tissue paper. In any event, the dust clogs the steam holes in the steambox faceplate This clogging of the steam holes can be extremely deleterious to the papermaking process. First, as the holes become clogged, less steam escapes from the steambox to impinge upon and heat the sheet. As a result, heating efficiency and subsequent sheet drying efficiency are decreased. Therefore, the paper production rate must be slowed since the paper will need to pass more slowly through the dryer section. Second, should the dust tend to accumulate preferentially on certain sections of the faceplate, steam may be prevented from leaving only those sections of the faceplate Thus, control of the cross-directional moisture content of the sheet is adversely affected.

Because of the accumulation of dust on the papermaking machinery and its adverse affect on the papermaking process, the papermaking machine must be cleaned periodically. Conventionally, the papermaking machinery is shut down and cleaned manually. However, this is a time consuming and therefore costly process. This is particularly true for modern high speed and expensive papermaking machines, where it is frequently essential for profitability that the machines be operated almost continuously. Accordingly, it would be desirable to automate the cleaning process and thus minimize "down-time" spent cleaning the machinery.

SUMMARY OF THE INVENTION

The present invention is directed toward a self-cleaning steambox designed for efficient steam heating of the paper sheet while reducing or eliminating the need for manually removing accumulated dust from the holes of the steambox faceplate.

The steambox includes an elongated steam plenum which preferably, but not necessarily, extends across the entire width of a sheet which is moving through the papermaking machine. One wall of the plenum, the faceplate, is disposed in close facing proximity to the moving sheet. The faceplate is perforated with numerous small, closely spaced steam exit holes for distributing the steam across the surface of each slice of the sheet.

The plenum is preferably sectionalized That is, the interior of the plenum is divided into chambers, each of which extends across less than the entire width of the sheet. Each steam chamber is disposed adjacent to and opposite a different slice of the sheet. A steam valve is associated with each chamber for selectively controlling the flow of steam from a steam supply pipe into each steam chamber and subsequently out the holes in the faceplate toward the opposing sheet slice.

At least one preferably high pressure pipe may be mounted to the exterior surface of the faceplate and extended across the entire length of the faceplate in the cross-direction. The pipe is provided with holes or nozzles disposed at intervals across the length of the faceplate. The pipe is coupled to a high pressure water supply which, upon opening a valve, fills the pipe with the pressurized water. The water then jets out of the nozzles and is directed toward the faceplate, thereby washing the dust from the faceplate, and particularly cleansing the steam holes of accumulated dust.

During normal paper production, steam is jetted out of the steam holes at a relatively low pressure. This steam pressure is, therefore, usually insufficient to remove accumulated dust. Moreover, during normal papermaking production, the water supply valve is maintained in the closed position, so that water will not be jetted from the nozzles and thereby interfere with paper production. However, paper production may be halted periodically and, during this time, the water supply valve can be opened to clean the faceplate and steam holes of accumulated dust.

DETAILED DESCRIPTION OF THE PREFERRED EMBODIMENTS

The following description is of the best presently contemplated modes of carrying out the invention. This description is made for the purpose of illustrating the general principles of the invention and should not be taken in a limiting sense. The scope of the invention is best determined by reference to the appended claims.

Figure 1:
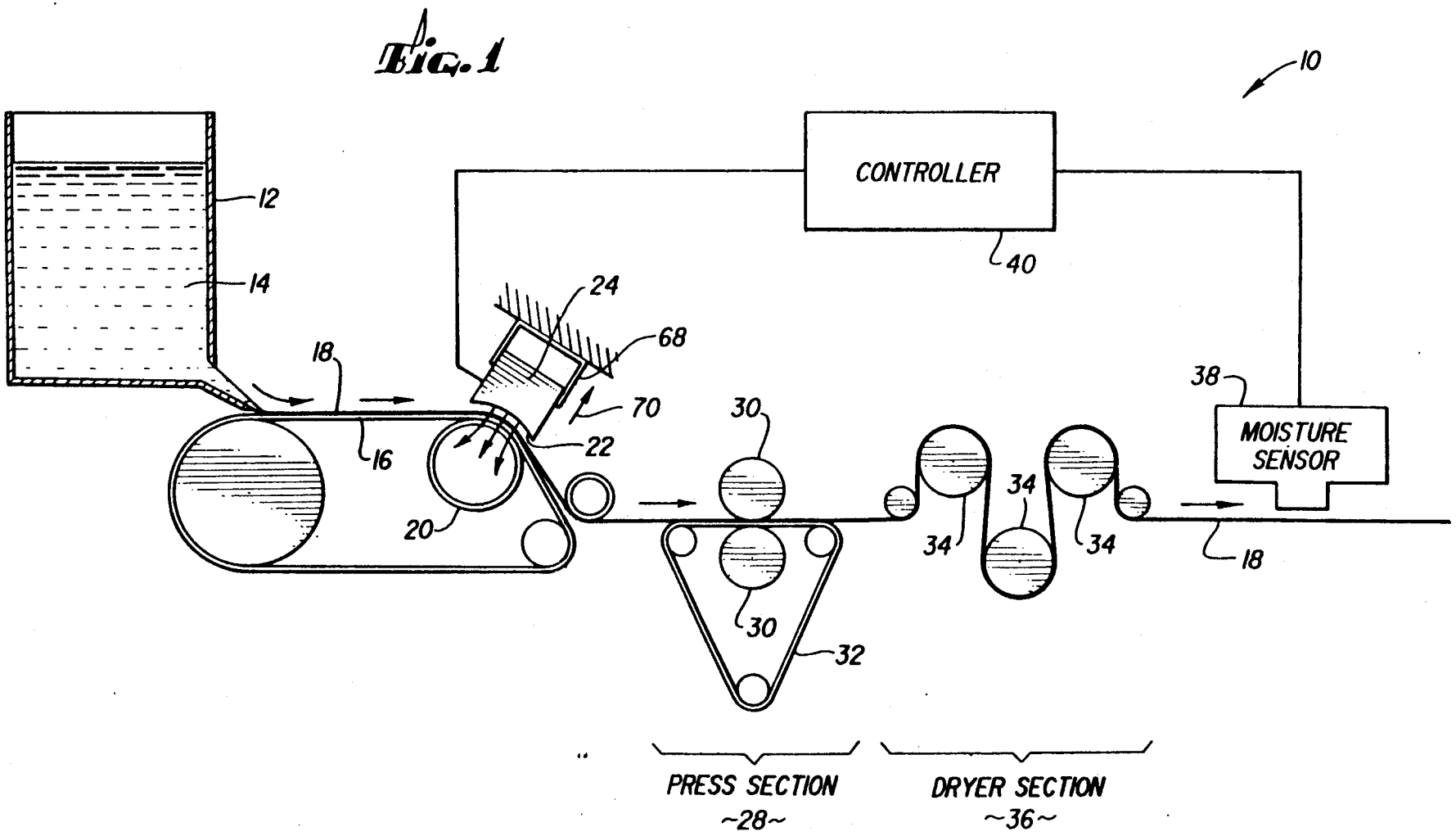
FIG. 1 is a simplified schematic view of a papermaking machine.
Figure 2:
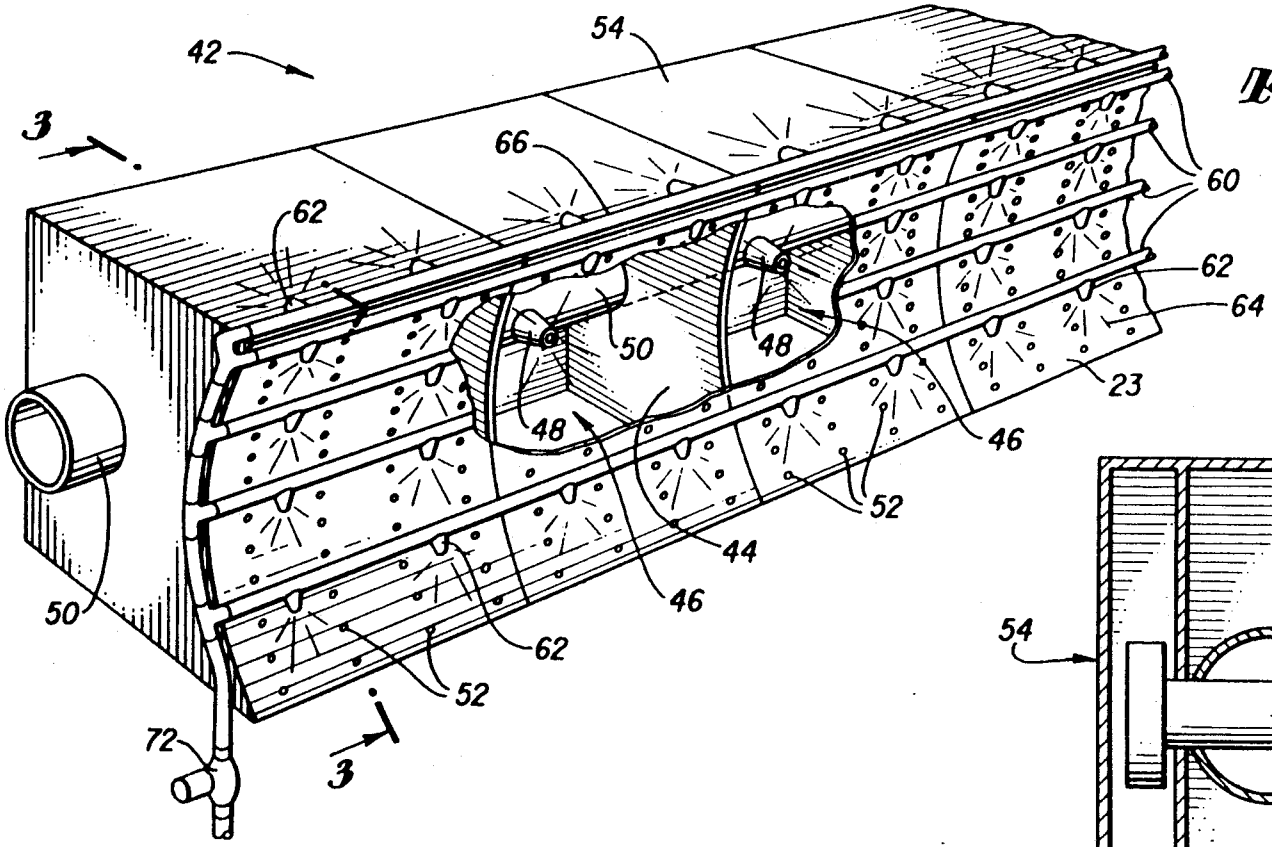
FIG. 2 is a perspective illustration of a self-cleaning steambox according to the present invention
Figure 3:
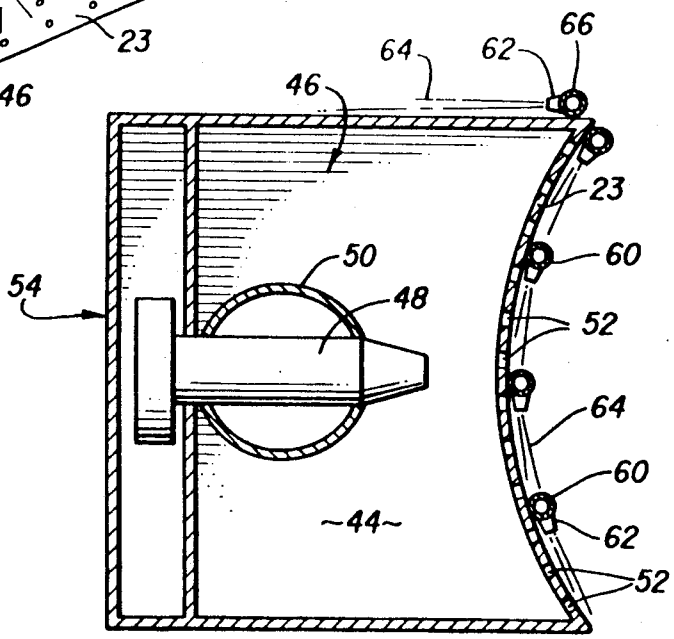
FIG. 3 is a cross-sectional illustration of the steambox of FIG. 2 taken along line 3-3.

FIGS. 2-3 illustrate a presently preferred embodiment of the self-cleaning steambox 42 of the present invention. The steambox 42 is provided with a number of interior walls 44 which divide the steambox 42 into a plurality of chambers 46. A separately controllable steam valve 48 is associated with each chamber 46 and coupled to a steam supply pipe 50 for separately and controllably supplying steam to each chamber 46. Opening and closing the valve 48 provides the associated chamber 46 with more or less steam, respectively. The steam then jets out of the holes 52 in the steam plenum faceplate 23 and is directed against the various cross-directional sections or slices of the sheet 18, as illustrated in FIG. 1 for steambox 24.

The plenum faceplate 23 is also provided with a plurality of pipes 60 which extend along the cross-direction of the exterior surface of the faceplate 23. Holes or nozzles 62 are formed in the pipes 60 at intervals across the faceplate 23 so that, when the pipes 60 are pressurized with water, jets 64 of high pressure water are directed against the faceplate 23. The water jets 64 clean the faceplate 23 by sweeping away accumulated dust. In particular, the jets 64 of water remove accumulated wood pulp fibers and mineral filler from the steam holes 52. The pipes 60 are pressurized with water from a high pressure water source In one embodiment, the pipes 60 may have an inside diameter of 15 mm and be provided with 1 mm diameter holes or nozzles spaced at 10 mm intervals across the faceplate 23. Water at 30–80 bar pressure may be supplied to each pipe 60 from both sides of the faceplate 23, to thereby provide a more even pressure distribution along the length of the pipes 60. When multiple pipes 60 are used, as shown in FIGS. 2-3, the pipes 60 may be spaced 140 mm apart, although this spacing may be varied depending upon water pressure, hole or nozzle size and spacing, and faceplate curvature.

Also, an additional pipe 66 may be disposed on the top surface of the steambox 42. Water jetted from this pipe 66 will remove accumulated dust from the top surface 54 of the steambox 24. Although a steambox 42 will typically have steam exit holes only in the faceplate 23, this additional pipe 66 serves to further facilitate cleaning of the steambox 24. When water is sprayed over the top of the steambox 42, then the steambox should be designed to prevent water from dripping onto and interfering with the operation of the valves 48.

In operation, according to the present invention, the steambox 42 may be mounted on a track, not shown, so that it may be periodically retracted along the track and away from the sheet 18, for example, in the direction of arrow 70 in FIG. 1. After the steambox 42 is retracted, valve 72 (FIG. 2) may be opened manually or under computer control to admit high pressure water into pipes, 60 and 66. As previously mentioned, this high pressure water jets out of the pipes 60, 62 to clean the steambox 42. Such cleaning is preferably conducted while the paper machine is shut down for adjustment or maintenance, so that the water and dust dripping from the steambox 42 will not adversely affect the quality of the manufactured paper sheet.

In certain papermills, the steambox 42 may be positioned under the paper sheet or on a track, pivot or other mechanism whereby the steambox 42 can be moved to a position where cleaning water dripping from the steambox 42 will not interfere with papermaking. In these situations, it may be possible to briefly retract the steambox 24, automatically clean the faceplate 23 as described above, and then quickly return the steambox 42 to its operating position. If the process is conducted quickly, then only a relatively small section of the sheet will not be steam treated. In some situations, this may be more cost effective than shutting down the entire papermaking machine.

Figure 4:
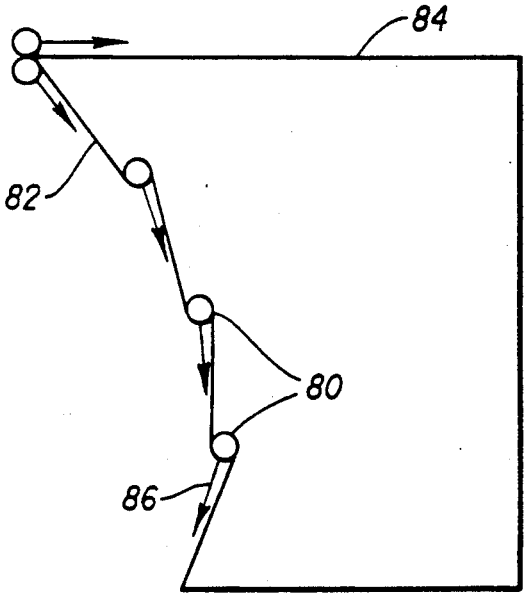
FIG. 4 illustrates another embodiment of a steambox according to the present invention.

FIG. 4 illustrates another embodiment of the present invention. In this embodiment, high pressure cleaning water pipes 80 are recessed into the surface of the faceplate 82 of steambox 84. Recessing the water pipes 80 facilitates cleaning because the path of the water jets 86 is not obstructed by an adjacent lower water pipe 80. Also, recessing the pipes 80 allows the steambox 84 to be mounted closer to the sheet.

Two preferred embodiments of the present invention have been described. Nevertheless, it will be understood that various modifications may be made without departing from the spirit and scope of the invention. For example, the steambox faceplate may have shapes other than the concave shape illustrated. The present invention will work equally well on steamboxes having planar faceplates or faceplates of other shapes. In addition, working fluids other than steam and water may be employed without departing from the principles of the present invention. For example, in certain situations, various cleaning solutions other than water may be utilized. Accordingly, it is to be understood that the present invention is not limited to the specific illustrated embodiments, but only by the scope of the appended claims.

We claim:

1. A steambox faceplate comprising at least one hole for directing steam toward a sheet and a plurality of spaced pipes mounted to the faceplate and extending along the length of the faceplate, wherein each pipe has a plurality of holes spaced at intervals along the length of each pipe for directing a cleaning fluid across the faceplate.

2. The steambox faceplate of claim 1, wherein the pipes are recessed into the faceplate.

3. A self-cleaning sheet treating device, comprising:

a plenum including a faceplate having at least one hole therein for emitting a first sheet treating fluid from the plenum, at least one dividing wall disposed within the plenum to divide the plenum into a plurality of chambers;

cleaning mans for directing at least one jet of a second fluid across the faceplate for removing obstructions from the hole;

a first fluid supply means for supplying separately variable amounts of the first fluid to each chamber; and wherein the faceplate has a plurality of holes for emitting the first fluid from each chamber and the cleaning means includes means for directing jets of the second fluid toward the holes in the faceplate associated with each chamber.

4. The self-cleaning device of claim 3, wherein the device is a steambox, the first fluid includes steam and the second fluid includes water.

5. A self-cleaning steambox, comprising:

steam means for directing steam toward a sheet, wherein the steam means includes a faceplate having at least one hole therein;

cleaning means for automatically cleaning the at least one hole in the faceplate, wherein the cleaning means includes means for directing jets of fluid across the faceplate;

wherein the means for directing jets of fluid includes at least one pipe disposed along the exterior surface of the faceplate, and wherein the at least one pipe includes a plurality of holes for directing the jets of fluid across the faceplate.

6. The self-cleaning steambox of claim 5, further comprising water means, operatively coupled to the at least one pipe, for supplying the at least one pipe with pressurized water for jetting the water from the holes in the at least one pipe across the faceplate.

7. A self-cleaning steambox, comprising:

steam means for directing steam toward a sheet, wherein the steam means includes a faceplate having at least one hole therein; and cleaning means for automatically cleaning the hole in the faceplate, wherein the cleaning means includes means for directing at least one jet of fluid toward the hole, wherein the means for directing at least one jet of fluid includes a pipe, mounted to the steam means, and having at least one hole formed therein to direct a jet of fluid toward the at least one hole in the faceplate.

8. A self-cleaning steambox, comprising:

steam means for directing steam toward a sheet, wherein the steam means includes a faceplate having a plurality of holes therein; and cleaning mans for automatically cleaning the hole in the faceplate, wherein the cleaning means includes means for directing at least one jet of fluid toward the hole, wherein the means for directing at least one jet of fluid toward the hole includes a pipe extending along the faceplate and having a plurality of holes formed in the pipe.

9. The self-cleaning steambox of claim 7, wherein the pipe is recessed into the faceplate.

10. The self-cleaning steambox of claim 8, wherein the pipe is recessed into the faceplate.

11. The self-cleaning steambox of claim 5, wherein the at last one pipe is recessed into the faceplate.

* * * * *